United States Patent [19]

Kaufman et al.

[11] Patent Number: 4,749,641

[45] Date of Patent: Jun. 7, 1988

[54] IMAGING ELEMENT CONTAINING DYE MASKING COUPLER

[75] Inventors: John E. Kaufman; Max H. Stern, both of Rochester, N.Y.

[73] Assignee: Eastman Kodak Company, Rochester, N.Y.

[21] Appl. No.: 907,559

[22] Filed: Sep. 15, 1986

[51] Int. Cl.[4] ..... G03C 7/26; G03C 7/30; G03C 7/32; G03C 7/40

[52] U.S. Cl. ..... 430/359; 430/226; 430/361; 430/543; 430/549; 430/553; 430/555; 430/557

[58] Field of Search ..... 430/359, 361, 226, 542, 430/543, 549, 553, 555, 557

[56] References Cited

U.S. PATENT DOCUMENTS

| | | | |
|---|---|---|---|
| 2,449,966 | 9/1948 | Hanson, Jr. | 430/396 |
| 3,186,840 | 6/1965 | Puschel et al. | 430/361 |
| 3,880,658 | 4/1975 | Lestina et al. | 430/226 |
| 4,046,573 | 9/1977 | Inouye et al. | 430/226 |

OTHER PUBLICATIONS

Research Disclosure 17643, Dec. 1978, pp. 22–31.

*Primary Examiner*—Richard L. Schilling
*Attorney, Agent, or Firm*—Thomas F. Kirchoff

[57] ABSTRACT

An imaging element is described which comprises a colorless coupler compound which contains an oxidizable lueco dye moiety and optionally a colorless dye image-forming coupler compound. Following color development a masking dye is obtained by oxidation of the leuco dye moiety in areas where no photographic development occurs.

5 Claims, No Drawings

IMAGING ELEMENT CONTAINING DYE MASKING COUPLER

This invention relates to photography. In particular, it relates to a photographic imaging element containing a dye-forming coupler having attached thereto a moiety capable of providing a masking dye.

Dyes employed in imaging applications are known to be inefficient with respect to transmitting all of the electromagnetic radiation expected from theoretical considerations. Whereas a dye which is capable of absorbing radiation in a given region of the spectrum should ideally transmit radiation in all other regions of the spectrum, practical experience shows that such expectations are not realized. For example, a cyan dye is expected to absorb radiation in the red region of the visible spectrum and to transmit radiation in the green and blue regions. In reality, cyan dyes also absorb some radiation in both the green and blue regions of the electromagnetic spectrum.

Unwanted absorption is also associated with magenta and yellow dyes, as well as with dyes having pricipal absorption properties in regions of the ultraviolet and the infrared. The result of this phenomenon is that unwanted absorption is introduced to an imaging element or process, thereby adversely affecting the quality of the resulting image.

Efforts to correct this problem have been focused on techniques which utilize preformed dyes as color masking agents. Such techniques are described in U.S. Pat. No. 2,449,966 and in Research Disclosure, Publication No. 17643, Paragraph VII, December, 1978. Preformed dyes, particularly when incorporated in silver halide emulsion layers, inasmuch as they are already colored, act as filters by absorbing a portion of the radiation which otherwise is intended to be absorbed by the silver halide. This results in loss of photographic sensitivity.

Some measure of success has been realized with color masking dyes when they are employed in a single-color photographic element. However, when multicolor elements are used, this technique is not satisfactory because only a single layer benefits from the masking dye as the remaining layers continue to absorb radiation in unwanted areas.

One way of eliminating unwanted absorption is to coat the silver halide and the dye in separate layers. Although this solution accomplishes the desired objective, it has the adverse effect of increasing the number of layers in an imaging element. This results in a thicker element which adversely affects not only the imaging process but also the manufacturing operation.

Accordingly, it is desirable to obtain a means for effectively masking unwanted dye absorption over multiple radiation transmission bands without loss of desirable photographic properties.

In accordance with this invention, there is provided an imaging element comprising a support having thereon at least one photosensitive silver halide emulsion layer having associated threwith a colorless coupler compound which has attached thereto an oxidizable leuco dye moiety, which moiety is capable of being removed from said element as a function of silver halide development and which, in areas where no development occurs, is capable of being oxidized to provide a masking dye.

In a preferred embodiment of this invention the imaging element also comprises a colorless dye image-forming coupler compound which is capable of providing an imaging dye.

This invention also provides a process of color correction which comprises the steps of:

(a) imagewise exposing an imaging element which comprises a support having thereon at least one photosensitive silver halide emulsion layer having associated therewith a colorless coupler compound which has attached thereto an oxidizable leuco dye moiety, which moiety is capable of being removed from the colorless coupler compound as a function of silver halide development;

(b) developing the imagewise-exposed areas of said element with color-developing agent, thereby removing from said element, as a function of silver halide development, a soluble leuco dye; and then (c) subjecting the developed element to oxidation to convert any leuco-dye moiety, in areas where no development occurred, to a masking dye.

A preferred process comprises use of an imaging element which also comprises a colorless dye image-forming coupler compound which is capable of providing an imaging dye. A most preferred process employs an imaging element wherein the oxidizable leuco dye moiety is attached to a coupling-off position on the colorless coupler compound.

Improved image reproduction can be obtained in a variety of imaging elements utilizing this invention. For example, magenta masking of an incorporated coupler color negative photographic element can be achieved by use of an oxidizable leuco dye moiety which is a magenta dye precursor, which is attached to a colorless coupler compound. A separate colorless cyan dye image-forming compound can be incorporated in the element. Following imagewise exposure and color development in exposed areas, a cyan image dye and a soluble leuco dye are formed, the leuco dye being removed and washed out of the element. No unwanted dye absorption occurs in the negative dye image region.

During a subsequent bleaching step, the leuco dye moiety, which is present in areas where silver halide development has not taken place, is oxidized to form a positive magenta masking dye. This masking dye corrects for unwanted light absorption by the cyan image dye in the imaging element.

In a preferred embodiment of the above description the oxidizable leuco dye moiety, which is the magenta dye precursor, is attached to the colorless coupler compound at the coupling-off position thereof.

In a similar fashion, yellow masking of an incorporated coupler color negative photographic element can be achieved by attaching a leuco dye moiety, which is a yellow-dye precursor, to the coupling-off position of a colorless coupler compound. After imagewise exposure and color development, a soluble leuco dye is formed in the areas of exposure. The leco dye is released from the colorless coupler compound and is removed from the photographic element by washing. No unwanted dye absorption occurs in the negative dye image region.

During a subsequent bleaching step, the leuco dye moiety, which is still attached to the colorless coupler compound in those areas where silver halide development has not taken place, is oxidized to form a positive yellow masking dye. The yellow masking dye corrects for unwanted light absorption by an imaging dye, for example a magenta image dye, present in the photographic element.

Cyan masking of an incorporated coupler imaging element can be achieved by attaching a leuco dye moiety, which is a cyan-dye precursor, to the coupling-off position of a colorless coupler compound. An image dye-forming coupler, which is an infrared dye-forming coupler, can be added to the imaging element. After imagewise exposure and color development, an infrared image dye and a soluble leuco dye are formed in the exposure areas. The leuco dye is released from the colorless coupler compound and is removed from the imaging element by washing. No unwanted dye absorption occurs in the negative dye image region.

The leuco dye moiety, which is still attached to the colorless coupler compound in areas where there has been no silver halide development, is oxidized by bleaching to form a positive cyan masking dye capable of correcting for unwanted absorption by the infrared dye in the imaging element.

Each of the above-noted illustrations involves use of a leuco dye moiety, which is a dye precursor, which provides a dye capable of absorbing radiation on the short wavelength side of the absorption range of the imaging dye, thereby preventing loss of speed attributed to transmitted light. The concept of this invention extends also to masking for unwanted radiation absorption on the long wavelength side of the absorption range of the imaging dye, thereby preventing loss of speed attributed to reflected light.

For example, cyan masking of an incorporated coupler color negative photographic element can be achieved by using coupler Compound 6, as described below, which has attached thereto a leuco dye moiety, which is a cyan-dye precursor, to the coupling-off position of the colorless coupler compound. A magenta dye image-forming coupler compound can also be contained in the photographic element.

Following imagewise exposure and color development, a magenta image dye and a soluble leuco dye are formed in exposed areas of the photographic element. The leuco dye is released from the colorless coupler compound and is washed out of the element. No unwanted dye absorption occurs in the negative dye image region.

As the result of a subsequent bleaching step, the leuco dye moiety, which is still attached to the colorless coupler compound in areas where silver halide development has not taken place, is oxidized to form a positive cyan masking dye. This dye is capable of correcting unwanted radiation absorption on the long wavelength side of the absorption band for the magenta dye.

The colorless dye image-forming coupler compound capable of providing an imaging dye can include any of many known coupler compounds which react, or couple, with oxidation products of a primary aromatic amino color developing agent to form a dye. Typical useful color coupler compounds include phenolic, 5-pyrazolone, heterocyclic and open-chain ketomethylene compounds.

Particular cyan, magenta and yellow color coupler compounds which can be used in this invention are described in U.S. Pat. Nos. 2,600,788; 2,710,803; 2,772,162; 2,875,051; 2,895,826; 3,062,653; 3,265,506; 3,408,194; 3,737,316; 3,785,829 and 4,333,999, the disclosures of which are incorporated herein by reference.

The described colorless dye image-forming coupler compounds are preferably ballasted so as to impart "bulkiness" to the compounds to prevent their migration from the layers in which they are coated to other layers of an imaging element.

Colorless coupler compounds which can be used in this invention include the following:

Compound 1

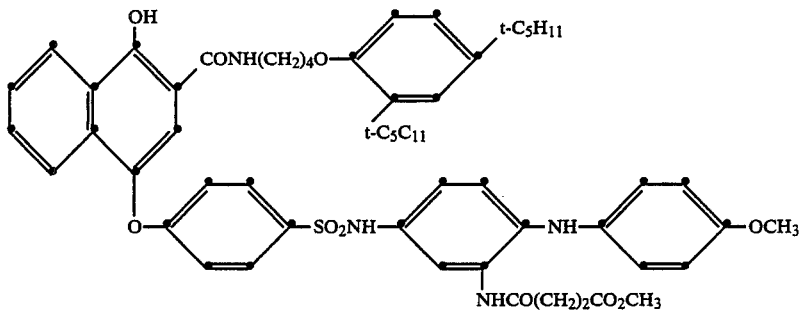

Compound 2

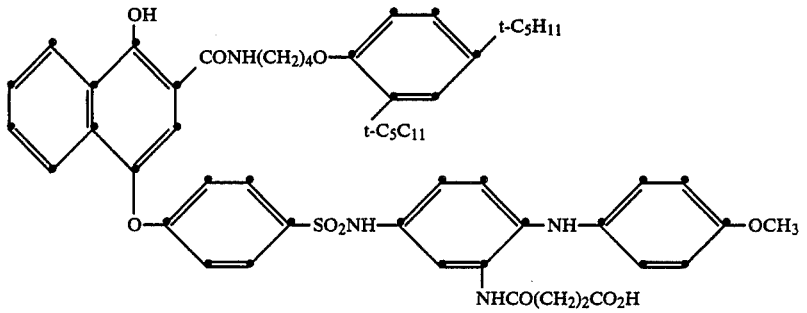

-continued
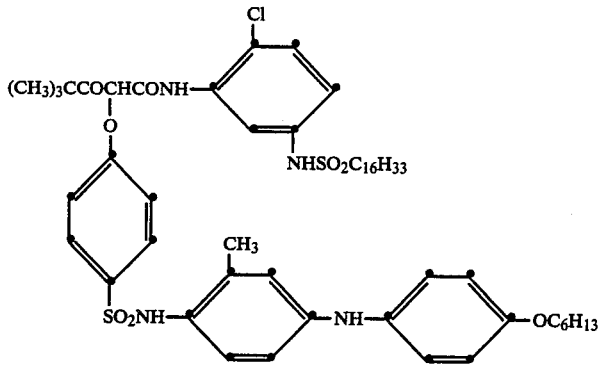
Compound 3
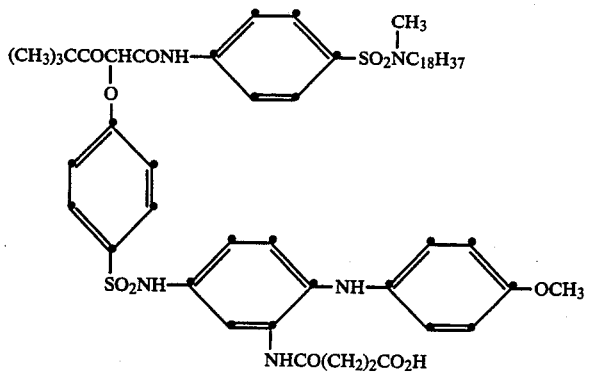
Compound 4
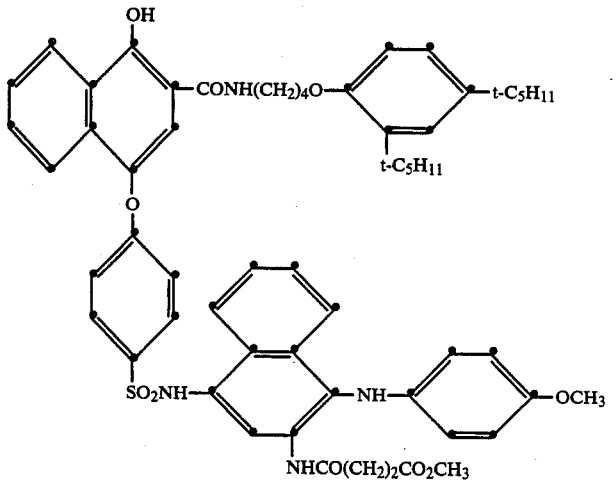
Compound 5

-continued

Compound 6

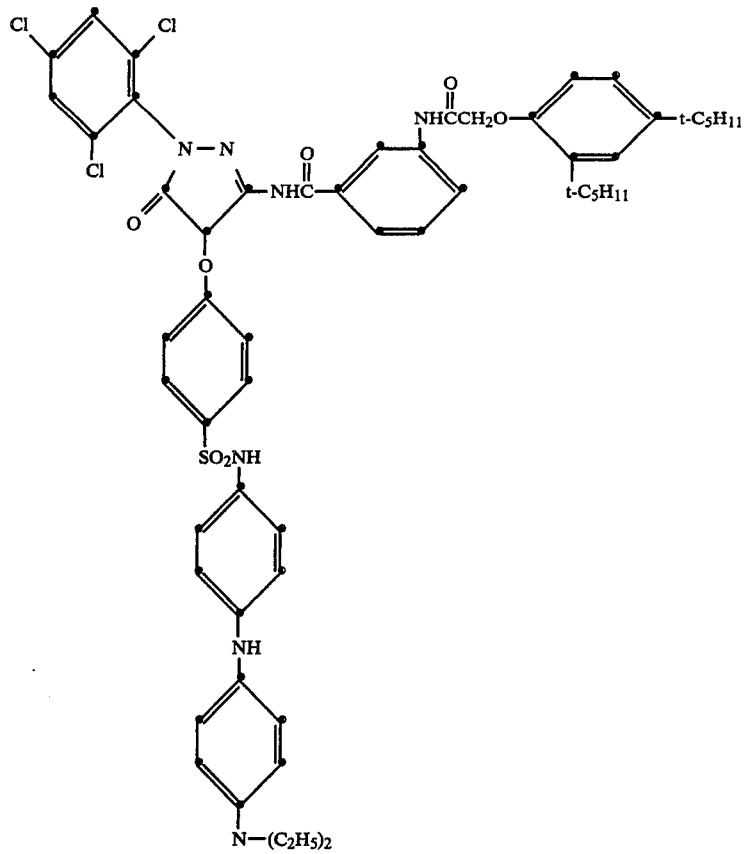

A colorless coupler compound used in this invention can be prepared by attaching an oxidizable leuco dye precursor moiety to the colorless coupler, preferably at the coupling-off position thereof. The colorless coupler is preferably ballasted so that it is rendered immobile in the layer of the imaging element in which it is coated.

Imaging elements of this invention in which the described coupler compounds are incorporated can be elements comprising a support and one or more silver halide emulsion layers. The coupler compounds are preferably incorporated in a silver halide emulsion layer. However, they can be incorporated in another layer, such as a layer adjacent a silver halide layer, where they will come into reactive association with oxidized color-developing agent which contains developed silver halide. Additionally, a silver halide emulsion layer and an adjacent layer containing the coupler compound can contain addenda conventionally contained in such layers.

The practice of this invention is possible in single color or in multicolor imaging elements. The invention is useful in a variety of layer arrangements well-known in the art.

In a preferred embodiment, the imaging element of this invention is a multicolor photographic element which comprises a support having thereon a red-sensitive silver halide emulsion layer having associated therewith a cyan dye image-forming coupler compound, a green sensitive silver halide emulsion layer having associated therewith a magenta dye image-forming coupler compound, and a blue-sensitive silver halide emulsion layer having associated therewith a yellow dye image-forming coupler compound, at least one of said emulsion layers also comprising a colorless coupler compound which has attached thereto an oxidizable leuco dye moiety which is capable of being released from the colorless coupler compound and removed from the imaging element as a function of silver halide development and which, in areas where the leuco dye moiety remains attached to the colorless coupler compound, is capable of being oxidized to provide a masking dye.

The colorless coupler compounds described herein can be incorporated into or associated with one or more units or layers of the element. The element can contain additional layers such as filter layers, interlayers, overcoat layers or subbing layers.

Processing of the elements of this invention can be accomplished by conventional techniques which include treating an imagewise-exposed element with an alkaline processing solution containing a color-developing agent (and another developing agent, if desired) to form an imagewise release of soluble leuco dye which is then washed out of the element. Particularly useful developing agents are color developing agents, including aminophenols, phenylenediamines, tetrahydroquinolines and the like as described, for example, in *Research Disclosure,* December 1978, Item 17643, paragraph XX, published by Industrial Opportunities Ltd., Homewell Havant, Hampshire PO9 IEF, UK, the disclosures of which are incorporated herein by reference. Other useful developing agents include hydroquinones, catechols and pyrazolidones.

The bleaching step which follows color development, and which is necessary to convert the leuco dye moiety which is still attached to the colorless coupler compound, to a masking dye, is preferably accomplished with a bleaching agent having a relatively high redox potential. Good results are obtained using ferricyanide based bleaches.

Typical silver halide emulsions can include coarse, medium or fine grains or mixtures thereof. The grains may be of different morphologies, e.g., spherical, cubic, cubooctahedral, tabular, etc., or mixtures thereto. Grain size distribution may be monodisperse or polydisperse or mixtures thereof. Such silver halides include silver chloride, silver bromide, silver bromoiodide, silver chlorobromide, silver chloroiodide, silver chlorobromoiodide and mixtures thereof. The emulsions can be negative-working or direct-positive emulsions. They can form latent images predominantly on the surface of the silver halide grains or predominantly on the interior of the grains. They can be chemically and spectrally sensitized. The emulsions preferably contain gelatin, although other natural or synthetic hydrophilic colloids, soluble polymers or mixtures thereof can be used, if desired. Suitable emulsions and their preparation are described in *Research Disclosure,* publication 17643, noted above, and in Research Disclosure, January 1983, Item 22534.

Supports for the imaging elements of this invention can be any suitable substrate commonly used in photographic elements. Examples of such supports include films of cellulose nitrate, cellulose acetates, poly(vinyl acetal), polyesters [(e.g. poly(ethylene terephthalate)], polycarbonates and other resinous materials or glass, metals, paper and the like.

The term "associated therewith" as used herein is intended to mean that the materials can be in either the same or different layers so long as the materials are accessible to one another.

The following examples describe preparation of colorless dye-forming coupler compounds useful in this invention. Unless otherwise indicated all parts, percents and ratios are by weight.

SYNTHESIS OF COLORLESS DYE-FORMING COUPLER COMPOUND 1

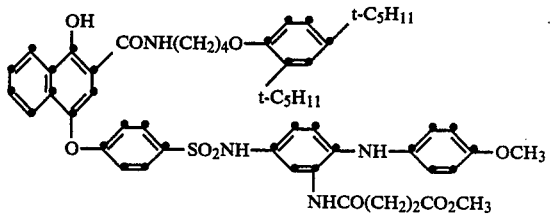

A schematic representation of the reactions involved in this synthesis is as follows:

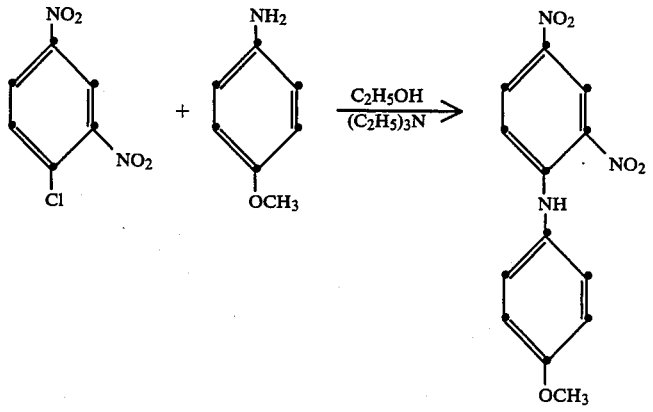

I-1

-continued

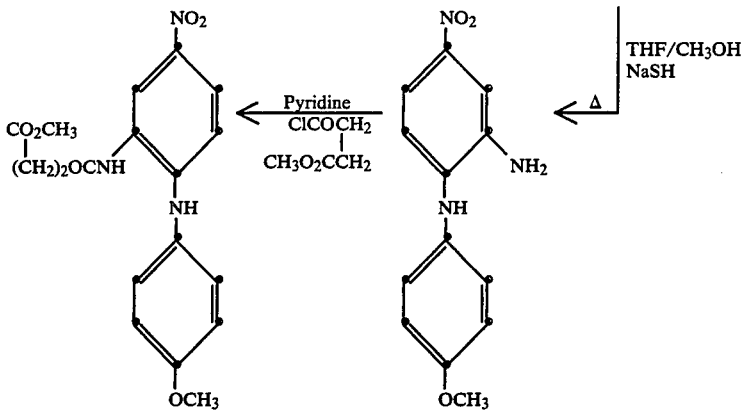

I-3 I-2

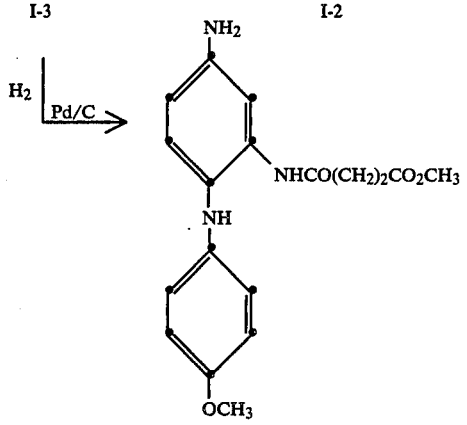

I-4

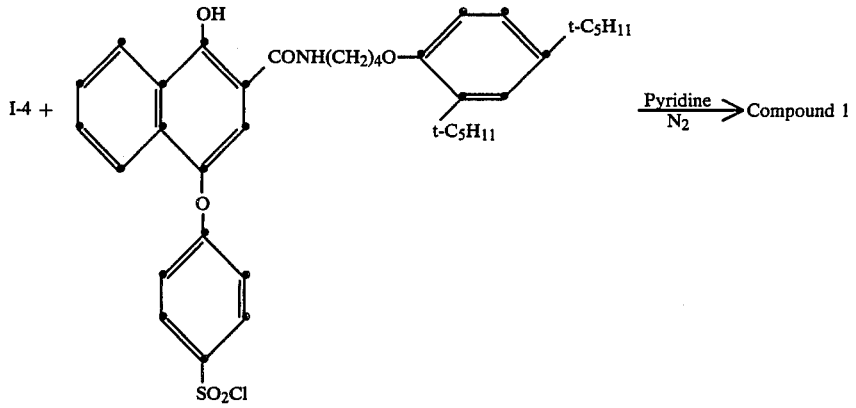

I-5

SYNTHESIS OF INTERMEDIATE I-1

To a solution of 1-chloro-2,4-dinitrobenzene (60.6 g, 0.3 mole) and ethanol (500 ml) was added, with stirring at room temperature, p-anisidine (37 g, 0.3 mole) and triethylamine (35 g). The reaction was exothermic, during which an orange color formed and the components dissolved into solution. After stirring for 20 min, orange crystals formed. After standing for 6 hrs at 0° C., the mixture was filtered to yield 71 g of crude Intermediate I-1. Recrystallization from ethanol yielded 62 g. (71.4%) of product (m.p. 139–40 C.).

SYNTHESIS OF INTERMEDIATE I-2

Methanol (200 ml) was added to a solution of I-1 (40 g, 0.14 mole) and tetrahydrofuran (350 ml). The mixture was heated on a steam bath. A slurry of sodium hydrogen sulfide (60 g, 1.07 moles) and methanol was added with stirring to the hot solution. After stirring the darkened solution for about 30 min, an additional slurry of $NaSH/CH_3OH$ (10 g) was added. Stirring was continued for another 30 min with continued heating, and the mixture was then filtered. The filtrate was flash-evaporated to a solid. The solid was dissolved in ethyl acetate and then filtered. The filtrate was again flash-evaporated to yield I-2.

SYNTHESIS OF INTERMEDIATE I-3

The I-2 intermediate recovered in the preceding step was dissolved in pyridine (250 ml) and combined with the half methyl ester of succinyl chloride (22 g, 0.146 mole). After a mild exothermic reaction, the solution was added rapidly to a ice/$H_2O$/HCl mixture to yield a bright-yellow solid which was collected by filtration. The solid was twice recrystallized from ethanol to yield 42.2 g (81.7% of I-3) having a m.p. of 153°-155° C.

SYNTHESIS OF INTERMEDIATE I-4

I-3 (10 g, 0.027 mole) was dissolved in tetrahydrofuran (125 ml) and reduced by shaking with 10% Pd/C (3.0 g) on a Parr shaker with $H_2$. Shaking was continued overnight to yield I-4 which was not isolated.

SYNTHESIS OF COLORLESS COUPLER COMPOUND 1

The crude I-4 Intermediate recovered from the preceding step was dissolved in pyridine (50 ml) and added to a solution of I-5 (as identified above, 16.0 g, $1.59\times10^{-3}$ mole) in pyridine (200 ml) and allowed to stand at room temperature under nitrogen for 2 hours. The solution was poured onto ice/$H_2O$/HCl to yield a blue-gray precipitate which was collected by filtration, dissolved in dichloromethane, dried and flash-evaporated to yield a purple oil. The oil was dissolved in anhydrous ethanol and allowed to stand for several hours. Grayish-white crystals formed and were collected by filtration. Recrystallization was from ethanol. Yield 19.2 g (73.7% based on the starting dinitro compound).

SYNTHESIS OF COLORLESS DYE-FORMING COUPLER COMPOUND 2

Colorless Dye-Forming Coupler Compound 1 (3.25 g, 0.003 mole) was warmed to 35° C. in a solution of 5 ml 10% aqueous sodium hydroxide in 50 ml of ethanol. The Compound dissolved in less than one minute. The solution was poured into a mixture of ice, water, and hydrochloric acid. A precipitate which resulted was filtered and recrystallized twice from ethanol. Yield 2.3 g, (71.8%) of Colorless Coupler Compound 2.

SYNTHESIS OF COLORLESS DYE-FORMING COUPLER COMPOUND 5

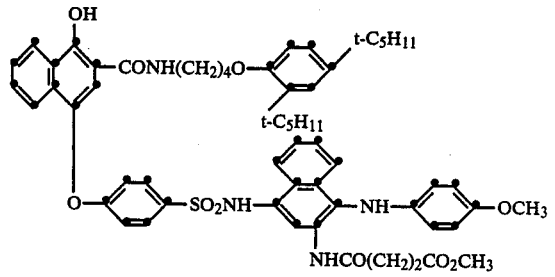

A schematic representation of the reactions involved in this synthesis is as follows:

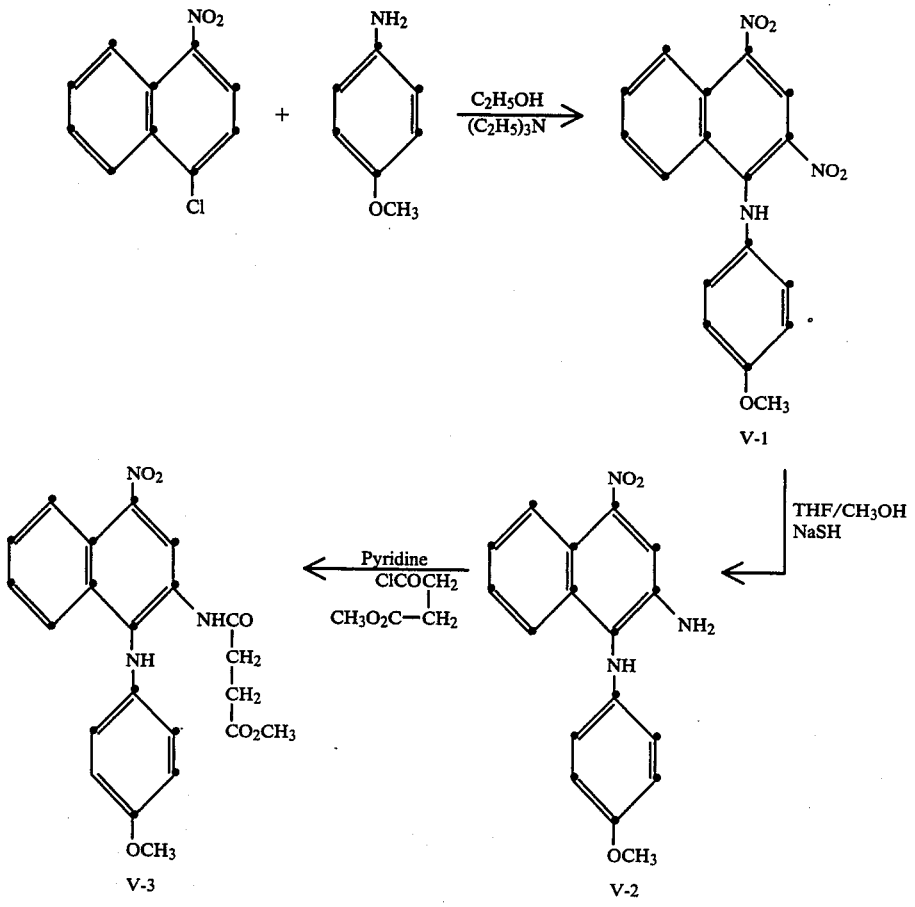

-continued

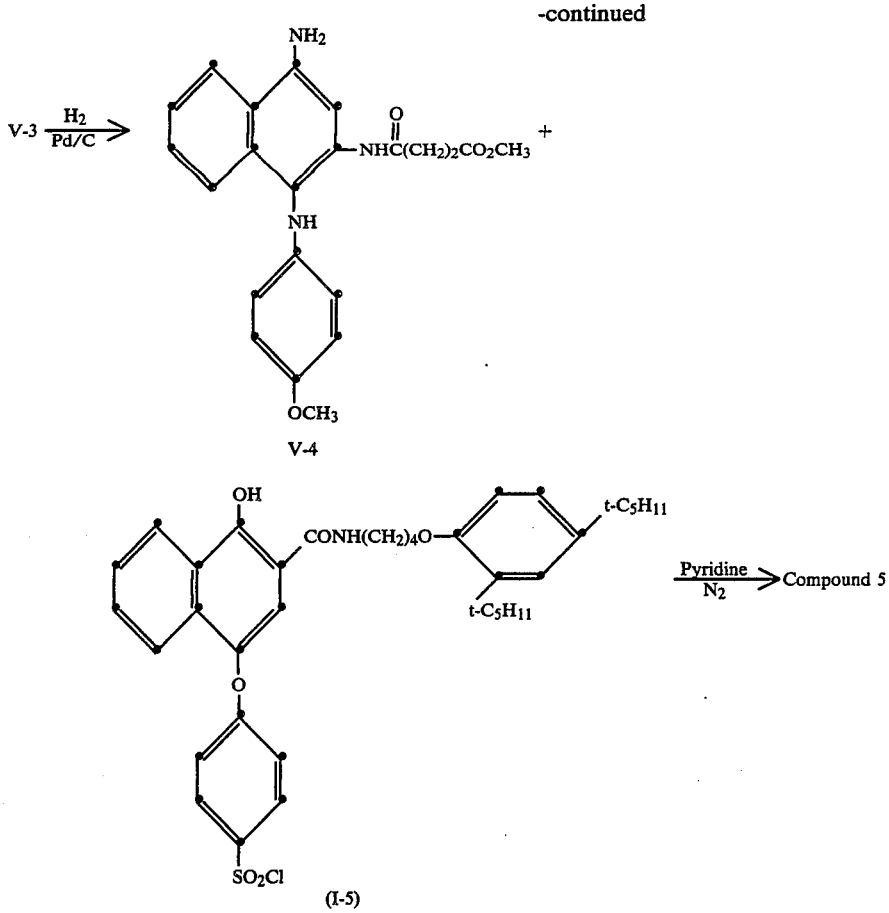

SYNTHESIS OF INTERMEDIATE V-1

To a solution of 1-chloro-2,4-dinitronaphthalene (25.2 g, 0.1 mole) and ethanol (300 ml) was added with stirring at room temperature, p-anisidine (12.3 g, 0.1 mole) and triethylamine (5.5 g). The reaction was mildly exothermic, and a dark orange solution formed. After stirring for three hours at room temperature, the resulting mixture was filtered to yield orange crystals of Intermediate V-1 (24.6 g, 72.5%; m.p. 200°-201 C.°).

SYNTHESIS OF INTERMEDIATE V-2

The diarylamine V-1 was dissolved in methanol (100 ml) and tetrahydrofuran (200 ml). The mixture was heated on a steambath to 50° C. A slurry of sodium hydrogen sulfide (20 g, 0.31 moles) and methanol was added portionwise with stirring to the warm solution. After 30 minutes of stirring the mixture was cooled to 5° C., and filtered. The filtrate was flash-evaporated to a solid, which was dissolved in ethyl acetate, filtered, and washed twice with water. The solution was dried with anhydrous sodium sulfate and again flash-evaporated to yield a dark orange oil, which was recrystallized from ethanol to yield 7.2 g (79%) of V-2 (m.p. 151°-153° C.).

SYNTHESIS OF INTERMEDIATE V-3

V-2 intermediate (6.2 g, 0.02 mole) was dissolved in pyridine (40 ml), carbomethoxypropionyl chloride (3.3 g, 0.21 mole) was added with stirring. After a mild exothermic reaction, the solution was poured into an ice/water/HCl mixture to yield a bright yellow solid. The solid was dissolved in ethyl acetate and the solution washed with 2% aqueous HCl, dried with anhydrous sodium sulfate, and flash-evaporated to an oil which was recrystallized from ethanol to yield 7.4 g (87%) of product V-3.

SYNTHESIS OF INTERMEDIATE V-4

The nitro compound, V-3, (7.0 g, 0.016 mole) was dissolved in tetrahydrofuran (120 ml) and reduced by shaking with 10% Pd/C (3.0 g) on a Parr apparatus with hydrogen (40 psi). The catalyst was removed by filtration and the filtration flash-evaporated to yield a light oil which was used directly in the nest reaction.

SYNTHESIS OF COLORLESS COUPLER COMPOUND 5

The crude V-4 intermediate (6.0 g) recovered from the preceding step was dissolved in pyridine (80 ml) and added to a solution of I-5 (as identified above, 9.9 g, 0.0014 mole) in pyridine (100 ml) and stirred at room temperature under nitrogen for 2 hours. The resulting dark purple solution was poured onto ice/water/HCl to yield a blue-gray precipitate which was collected by filtration, dissolved in dichloromethane, dried, and flash-evaporated to yield a purple oil. The oil was dissolved in ethanol and after standing for several hours, gray-white crystals formed. This solid was recrystallized from ethanol to yield Colorless Coupler Compound 5 (11 g, 70.5% yield, m.p. 138°-140° C.).

The following example further illustrates the invention:

Colorless Dye-Forming Coupler Compound 1, synthesized as described above, was dispersed in di-n-butyl phthalate (1:0.5) and coated in single layers at various levels (65, 129, 258, 517 and 1033 mg/m$^2$) with AgBrI (94:6) unsensitized tabular-grain emulsion (1076 mg Ag/m$^2$) prepared according to the procedure described in U.S. Pat. No. 4,434,226. The dried coatings were imagewise exposed and processed using the Kodak Flexicolor process as described in the *British Journal of Photography,* July 12, 1974 issue, pages 597–598, except that the following bleach solution was employed:

| | g/l |
|---|---|
| $K_3Fe(CN)_6$ | 30 |
| NaBr | 17 |
| Wate, to make | 1 liter |
| pH | 6.5 |

The absorption spectrum for the cyan coupler coating at 517 mg/m$^2$ showed a λmax value of 693 nm. The absorption spectrum for the magenta masking dye for this same coating showed a λmax value of 523 nm.

This invention has been described in detail with particular reference to preferred embodiments thereof, but it will be understood that variations and modifications can be effected within the spirit and scope of the invention.

We claim:

1. An imaging element comprising a support having thereon at least one photosensitive silver halide emulsion layer having associated therewith a colorless dye image-forming compound which is capable of providing an imaging dye and a colorless coupler compound which has attached to a coupling position thereof an oxidizable leuco dye moiety, which moiety is capable of being washed out of said element as a function of silver halide development and which, in areas where no development occurs, is capable of being oxidized to provide a masking dye which absorbs radiation on either the short or the long wavelength side of the absorption range of the imaging dye.

2. The imaging element of claim 1 wherein said colorless dye image-forming coupler compound is a magenta dye-forming coupler.

3. The imaging element of claim 1 wherein said colorless coupler compound has attached thereto an oxidizable leuco dye moiety which is a precursor for a yellow dye.

4. The imaging element of claim 1 which is a multicolor photographic element comprising a red-sensitive silver halide emulsion layer having associated therewith a cyan dye image-forming coupler compound, a green-sensitive silver halide emulsion layer having associated therewith a magenta dye image-forming coupler compound, and a blue-sensitive silver halide emulsion layer having associated therewith a yellow dye image-forming coupler compound.

5. A process of color correction which comprises the steps of:

(a) imagewise exposing an element which comprises a support having thereon at least one photosensitive silver halide emulsion layer having associated therewith a colorless dye image-forming coupler compound which is capable of providing an imaging dye and a colorless coupler compound which has attached to a coupling position thereof an oxidizable leuco dye moiety, which moiety is capable of being released from said colorless coupler compound as a function of silver halide development;

(b) developing the imagewise exposed areas of said element with color-developing agent, thereby removing from said element, as a function of silver halide development, a soluble leuco dye; and then (c) subjecting said developed element to oxidation to convert any leuco-dye moiety, in areas where no development occurred, to a masking dye which absorbs radiation on either the short or the long wavelength side of the absorption range of the imaging dye.

* * * * *